US007322444B2

(12) United States Patent
Allerding et al.

(10) Patent No.: US 7,322,444 B2
(45) Date of Patent: Jan. 29, 2008

(54) FORK-LIFT TRUCK

(75) Inventors: Uwe Allerding, Ehbsen (DE); Carsten Oestmann, Hamburg (DE); Matthias Duewel, Hamburg (DE)

(73) Assignee: Junghrinrich Aktiengesellschaft, Hamburg (DE)

( * ) Notice: Subject to any disclaimer, the term of this patent is extended or adjusted under 35 U.S.C. 154(b) by 543 days.

(21) Appl. No.: 10/775,420

(22) Filed: Feb. 10, 2004

(65) Prior Publication Data

US 2004/0159499 A1 Aug. 19, 2004

(30) Foreign Application Priority Data

Feb. 13, 2003 (DE) ..... 103 05 900

(51) Int. Cl.
*B66F 9/06* (2006.01)

(52) U.S. Cl. ..... 187/222; 414/620

(58) Field of Classification Search ..... 187/222; 414/620

See application file for complete search history.

(56) References Cited

U.S. PATENT DOCUMENTS 4,491,918 A * 1/1985 Yuki et al. ..... 701/50
4,942,529 A * 7/1990 Avitan et al. ..... 701/50
5,947,516 A * 9/1999 Ishikawa ..... 280/755

* cited by examiner

*Primary Examiner*—Thomas J Brahan
(74) *Attorney, Agent, or Firm*—Vidas, Arrett & Steinkraus, P.A.

(57) ABSTRACT

A fork-lift truck having a mast, a load-carrying means having a load-carrying fork which is supported by the mast and is adjustable in height by means of a lifting and lowering drive wherein the load-carrying fork is adjustable with respect to the horizontal line by means of an inclination drive, and an electric control and regulation device for the respective drives which is connected to operating members for the lifting and lowering drive and inclination drive, wherein an analog sensor detecting the inclined position of the load-carrying fork is provided the inclination signal of which is sent to the control and regulation device and that the control and regulation device is connected to a separate operating member for the inclination drive or the operating member for the inclination drive is configured in such a way that actuating it causes the load-carrying fork to be automatically moved to a predetermined position, preferably a horizontal position.

6 Claims, 1 Drawing Sheet

FORK-LIFT TRUCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Fork-lift trucks commonly comprise a load-carrying portion and a driving portion. The load-carrying portion has a mast which can be composed of several mast sections and which can be extracted to large heights, in case of need. A load-carrying means is movable in height on the mast by means of a lifting and lowering drive. The load-carrying means is primarily comprised of a so-called load-carrying fork which receives one or more pallets. A special type of fork-lift trucks is the so-called fork-lift reach truck the mast of which is horizontally movable between a position close to the driving section and a position remote therefrom. In addition, the load-carrying fork is movable transversely to the mast, mostly by means of an appropriate slider. A so-called side shift allows to orient the pallet precisely and quickly in the rack or the load-carrying fork to the pallet with no need for the fork-lift truck to change its position.

It is further known to vary the inclination of the load-carrying means and, hence, that of the fork. One option is to vary the mast inclination, e.g. to pivot the mast towards the driving portion to compensate the deflection of the mast, for example. Besides, a picked-up load will be supported more reliably during a travel mode if the load-carrying fork has an inclination by which the load has a tendency to slip towards the mast. The load-carrying fork which is to slide into a pallet requires that the load-carrying fork be substantially oriented horizontally. If the pallets exhibit an inclination from the horizontal line care should be taken to orient the fork correctly. Although the fork inclination can be varied by means of the inclination drive the driver of the fork-lift truck is not informed about the actual fork inclination. Specifically at large lifting heights, he cannot perceive whether the fork is oriented horizontally and can be smoothly slid into the pallet. One or more unsuccessful attempts to detect a pallet at a large height will naturally result in a longer handling time.

From DE 32 11 509 A1, it has become known to preset and store a target angle for the backward inclination of the mast in an industrial truck having a mast. The load resting on the fork is detected while modifying the backward inclination and the target angle. A sensor detects the real mast inclination relative to a vertical line in a no-load condition. The mast inclination angle detected is compared to the target angle stored. If the mast inclination angle detected is smaller than the target inclination angle an appropriate correction is made to the inclination angle. The arrangement described aims at obtaining a horizontal orientation of the prongs of the load-carrying fork, irrespective of which load is on the fork at which height. Floor irregularities, worn wheels, and age-induced deformations of the lift frame cannot be taken into account for the system described.

It is the object of the invention to provide a fork-lift truck in which the pallets can be picked up and stacked at larger lifting heights in a simple way.

BRIEF SUMMARY OF THE INVENTION

In the invention, an analog sensor detecting the inclined position of the load-carrying fork is provided and the inclination signal of which is sent to the control and regulation device. The control and regulation device, in a known manner, is in communication with operating members for the lifting and lowering drives as well as the inclination drive. If a change is to be made to the inclination of the mast an appropriate control element requires to be actuated for the purpose. When the fork-lift truck is a fork-lift reach truck a linear extraction actuator is provided for the mast that can be actuated via another control element. Finally, when the fork-lift truck has a side loader the side loader requires an appropriate drive which is actuated via a separate control element in the cabin of the fork-lift truck. When actuated by a separate operating member or the operating member exists anyhow for the inclination drive, the invention provides for the load-carrying fork to take its horizontal position automatically. To this end, the common operating member or control element for the mode of operation provides for the load-carrying fork to automatically move to the horizontal line.

The inclination measuring device can determine the respective inclination of the load-carrying fork from the mast or vehicle. Though, this does not always ensure that the fork will always be oriented horizontally when driven accordingly because a load-dependent deflection of the mast or a slanting position of the vehicle is not taken into account. However, such an analog sensor is adequate throughout to roughly determine the orientation of the fork. In an aspect of the invention, it is preferred to use a so-called inclination measuring device, e.g. a so-called inclinometer, which is in the form of an electric spirit level and capable of detecting the absolute horizontal position.

When the control element concerned sends a signal to the control and regulation device the inclination signal of the inclination sensor is evaluated in the device. The control and regulation device interlinks these signals and initiates a regulation procedure. Thus, the load-carrying fork can move to the horizontal position automatically when the driver gives a relevant instruction. This is also accomplished when the vehicle possibly stands slantingly or the mast is in a deflection caused by the load. In any case, the fork can be moved into the pallet easily and with no collision.

In an aspect of the invention, the control and regulation device sends a signal to the inclination drive to move it to the horizontal position when a signal for lowering or lifting the load-carrying means is produced by the actuation member for the lifting and lowering operation. The automatic adjustment to the horizontal position makes it possible to omit an operation which otherwise would be necessary prior to the next fork-lift truck cycle.

It is known to provide fork-lift trucks of the aforementioned type with an onboard computer. The onboard computer is supplied, amongst others, with parameters which are relevant for the stability of the vehicle. The onboard computer calculates the maximum travel speed from the signals. It is understood that when the load is lifted high or the weight of the load is large the travel speed has to be lower than when the vehicle is not loaded and the load-receiving means is in a low position. In an aspect of the invention, the inclination signal of the inclination sensor can also be sent to the onboard computer for a modification of the maximum traveling speed of the fork-lift truck, also in dependence on the inclined position of the load-carrying fork.

The inclination sensor can use common measuring means and the signals from the inclination sensor are transmitted to the switching circuitry for the control and regulation device via a cable or even by non-contracting transmission using known means.

BRIEF DESCRIPTION OF THE SEVERAL VIEWS OF THE DRAWINGS

The invention will be described in more detail below with reference to an embodiment shown in the drawings.

DETAILED DESCRIPTION OF THE INVENTION

Figure 1:
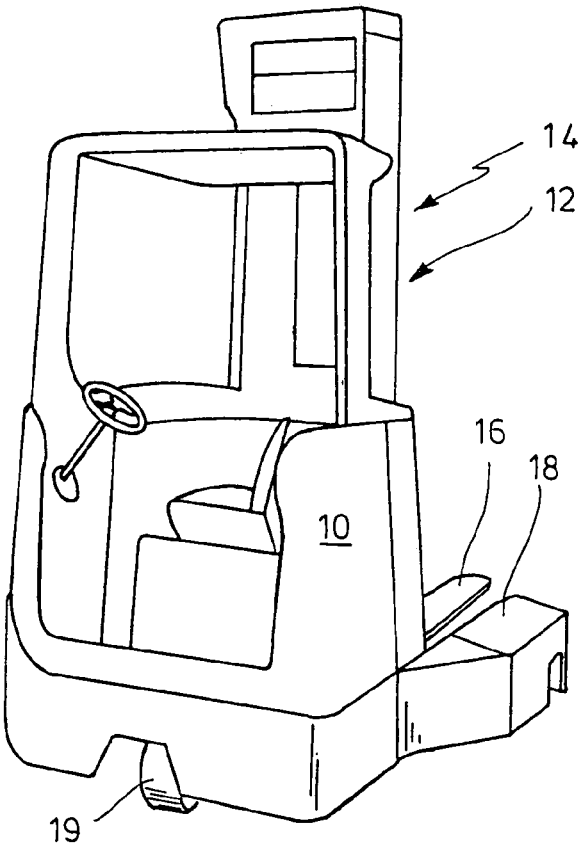
FIG. 1 schematically shows a perspective view of a fork-lift reach truck.

While this invention may be embodied in many different forms, there are described in detail herein a specific preferred embodiment of the invention. This description is an exemplification of the principles of the invention and is not intended to limit the invention to the particular embodiment illustrated The fork-lift reach truck shown in FIG. 1 is of a conventional construction and has a driving portion 10 and a load-carrying portion 12. The load-carrying portion 12 has a mast 14 which can have a plurality of mast sections, for example, and can be extracted to a height of 12 m or higher, for example. The load-carrying portion 12 also has a load-carrying means which is guided on the mast 14 in a height-adjustable fashion. In FIG. 1, merely one prong 16 of a load-carrying fork can be seen which is mounted on a carriage which is not shown and, in turn, is horizontally displaceable. The guide required for this purpose is mounted in a height-adjustable fashion on the mast 14 as is known as such for fork-lift trucks. The driving portion 10 has mounted thereon wheel arms which extend at a parallel distance on either side of the mast 14. One wheel arm can be seen at 18 in FIG. 1. The wheel arms 18 Support load-carrying wheels each. A steerable driving wheel is shown at 19.

The mast 14 is horizontally moved away from and towards the driving portion 10 by means of a guide which is not shown in detail. To this end, an control element, which is not shown, is provided in the cabin of the driving portion 10 to drive the linear mast extractor. Further, there is an control element in the cabin for the lifting and lowering operation of the load-carrying fork and the mast 14. In addition, the mast 14 is also variable in its inclination by means of an appropriate inclination drive. The inclination drive, in turn, can be actuated via a separate control element. Finally, there is also an operating member in the cabin to actuate the side shift described.

Figure 2:
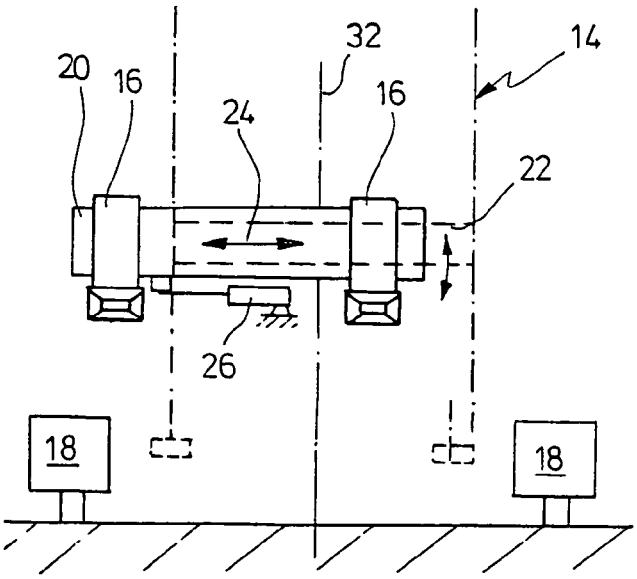
FIG. 2 very schematically shows a side view of the front portion of the fork-lift reach truck of FIG. 1.

The individual displacing motions are indicated by two-sided arrows in FIG. 2. The two-sided arrow 20 indicates the adjustability in height of a horizontal guide 22 for a side shift 24, the side shift being connected to the back 26 of a load-carrying fork which is generally designated 28. The two-sided arrow 30 indicates the extraction of the mast and the curved two-sided arrow 32 indicates the option to incline the mast 14. Finally, a curved two-sided arrow 34 indicates the change to the inclination of the prongs 16 or load-carrying fork 28. The drives for the displacing motions described are not shown in the drawing, even the one for regulating the fork inclination.

Figure 3:
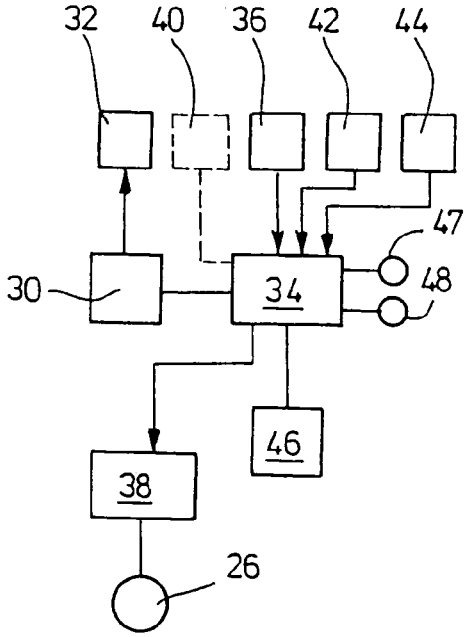
FIG. 3 Shows a block diagram for the operation of the fork-lift reach truck of FIG. 1.

The fork 28 has associated therewith an analog inclination sensor which is designated 40 in FIG. 3. The inclination sensor determines the inclination of the prongs 16 from the horizontal line and, in the simplest case, from the mast 14 or fork-lift truck or, more specifically, the absolute inclination from the horizontal line. The inclination signal is sent to a control and regulation device 42 for the operation of the mast and load-carrying means. The inclination signal also arrives at a display 42*a* which is installed in the cabin of the fork-lift truck. This always allows the driver to see the inclination of the fork 28 relative to the horizontal line.

In FIG. 3, 44 designates a control element for lifting and lowering the load-carrying fork 28 or guide 22 for the shifter 24 of the load-carrying fork 28. 46 designates an control element for the inclination of the mast 14. 48 designates a control element for the advancement of the mast 14. 50 designates a control element for the actuation of the side shift 24 and, thus, for the lateral displacement of the load-carrying fork 28. 52 designates a control element for the variation of the fork inclination. 54 designates a control element, e.g. a push-button switch, the signal of which is sent to the control and regulation device 42, like those of the other control elements 44 to 52. As a consequence of the signals from the inclination sensor 40 and control element 54, the control and regulation device 42 for the drive of the inclination of the fork 28 generates an appropriate setting signal until the fork prongs 16 have taken their horizontal position. Thus, the signal of the inclination sensor 40 serves as a real signal for a control loop whereas the required signal is formed by a value which was set or was measured and stored and which corresponds to the horizontal position of the load-carrying fork.

When the control element 44 is operated in the control and regulation device it becomes also possible to initiate a procedure according to which the fork 28 is automatically moved to the horizontal line before a lifting or lowering operation is initiated.

The inclination signal from the inclination sensor 40 can also be input to an onboard computer 56. The onboard computer 56 calculates the maximum speed for the travel motor, which is not shown, in accordance with stability criteria. Known stability criteria, for example, are the weight of the load on the load-carrying fork 28, the height of the load-carrying fork 28, the inclination of the mast 14, etc. The inclination signal of the inclination sensor is another stability criterion which is entered in the onboard computer 56 to determine a modification of the maximum travel speed. It is understood that attempts are made to predetermine a maximum travel speed which is as high as possible in order to maximize the volume of goods handled. A large number of stability criteria, when taken into account, helps achieve an optimization of the stability, on one hand, and that of the travel speed, on the other.

It is imaginable that positions deviating from the horizontal line are moved to. These positions can be provided to the control by a teaching procedure beforehand.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A fork-lift truck comprising:

a mast, a load carrying fork, a pair of actuation drives, one being a lifting and lowering drive, and one being an inclination drive, an analog sensor, and a control device, wherein:

the load-carrying fork is engaged to and supported by the mast and is adjustable in height by the lifting and lowering drive, the inclined position of the load-carrying fork is adjustable relative to a horizontal axis by the inclination drive, and the control device is in electrical communication with and regulates the actuation of the lifting and lowering drive and is in separate electrical communication with and separately regulates the inclination drive, said regulation comprises utilizing the analog sensor to detect the inclined position of the load-carrying fork relative to the horizontal axis and correspondingly emitting an inclination signal to the control device, the control device in turn processes the inclination signal and induces a coordinated actuation of both of the actuation drives such that they cause the load-carrying fork to be automatically moved to a predetermined position.

2. The fork-lift truck of claim 1, characterized in that the control device induces the load-carrying fork to be automatically moved to a horizontal position.

3. The fork-lift truck as claimed in claim 1, characterized in that the control device induces the inclination drive to move the load-carrying fork colinear with the horizontal axis when the lifting and lowering drive are induced by the control device to be actuated.

4. The fork-lift truck as claimed in claim 1 further comprising an engine and an onboard computer, the engine controlling the speed of the fork-lift truck, the onboard computer in controlling communication with the engine such that it limits the traveling speed and cornering speed of the fork-lift truck in conformity with stability criteria, the inclination signal is also received by the onboard computer for a modification of the maximum traveling speed of the fork-lift truck in dependence on the inclination signal.

5. The fork-lift truck of claim 1, characterized in that the control device measures the inclined position of the load-carrying fork relative to the horizontal axis.

6. The fork-lift truck of claim 1, characterized in that the control device induces the load-carrying fork to be automatically moved to a pre-determined height.

* * * * *